United States Patent [19]

Dutt

[11] 4,308,965

[45] Jan. 5, 1982

[54] UNITARY CAP OF TWO DISSIMILAR MATERIALS

[75] Inventor: Herbert V. Dutt, Bradenton, Fla.

[73] Assignee: Sun Coast Plastic Closures, Inc., Sarasota, Fla.

[21] Appl. No.: 87,662

[22] Filed: Oct. 24, 1979

[51] Int. Cl.[3] ..... B65D 53/00

[52] U.S. Cl. ..... 215/345; 215/DIG. 1

[58] Field of Search ..... 215/341, 343, 344, 345, 215/350, 352, DIG. 1

[56] References Cited

U.S. PATENT DOCUMENTS

| | | | |
|---|---|---|---|
| 1,910,913 | 5/1933 | Conner | 215/350 |
| 2,849,141 | 8/1958 | Abbiati | 215/345 |
| 3,189,209 | 6/1965 | Owens | 215/350 X |
| 3,215,297 | 11/1965 | Acton | 215/343 X |
| 3,458,077 | 7/1969 | Ryan | 215/350 X |
| 3,462,034 | 8/1969 | Friedberg | 215/350 X |
| 4,143,785 | 3/1979 | Ferrell | 215/DIG. 1 |

FOREIGN PATENT DOCUMENTS

| | | | |
|---|---|---|---|
| 597052 | 3/1978 | Switzerland | 215/350 |

*Primary Examiner*—Donald F. Norton

*Attorney, Agent, or Firm*—Arthur W. Fisher, III

[57] ABSTRACT

A unitary cap of two dissimilar materials for sealing containers such as bottles or jars comprising a rigid outer closure member and a substantially resilient inner sealing member formed together as a unitary cap wherein the substantially rigid outer closure member includes a top wall and a depending annular side wall which extends over and is adapted to be secured to the neck of a container, serrations are provided on the exterior surface of the substantially rigid outer closure member for gripping purposes, and a reinforcement shoulder is located on the outer perimeter of the depending annular side wall adjacent the lower edge thereof to prevent excessive cap expansion upon application to a container and the substantially resilient inner closure member includes a base sealing element bonded or anchored to the substantially rigid closure member disposed to engage the inner and outer rim edges and/or top surface of the container to which the unitary cap is applied.

5 Claims, 5 Drawing Figures

FIG. 1
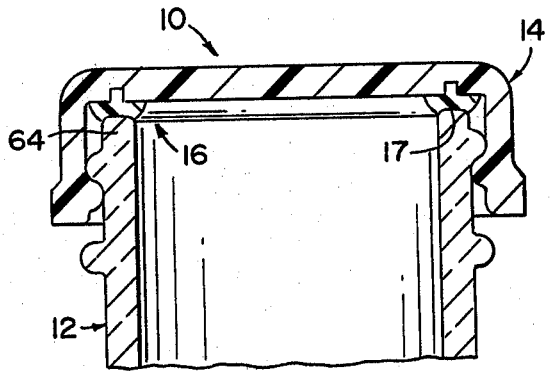
FIG. 2
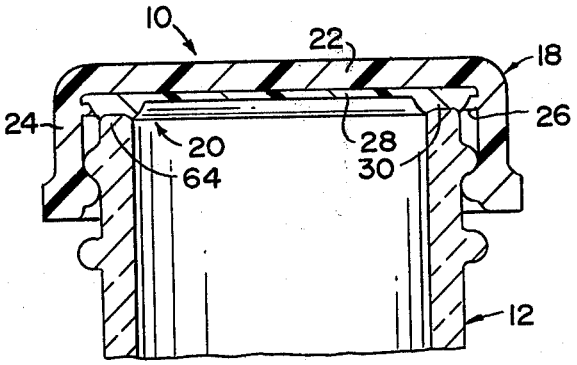
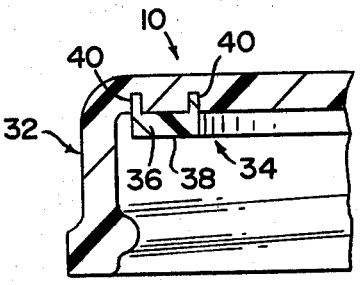
FIG. 3
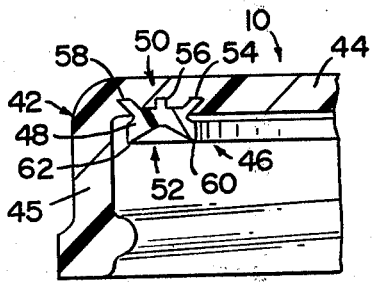
FIG. 4
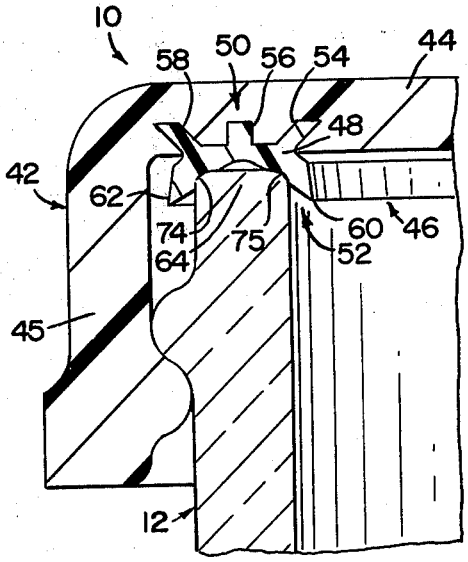
FIG. 5

UNITARY CAP OF TWO DISSIMILAR MATERIALS

BACKGROUND OF THE INVENTION

1. Field of the Invention

A unitary cap of two dissimilar materials for sealing containers such as bottles or jars comprising a substantially rigid outer closure member and a substantially resilient inner sealing member formed together as a unitary cap.

2. Description of the Prior Art

Particularly in food packing applications, but in other application as well where material in a container is subject to spoilage or degeneration in the presence of air, it is the practice in many cases to produce a relatively strong vacuum, pressure, or neutral atmosphere within the container for such material and to seal the container by means of a suitable closure such as a cap or cover to prevent air from entering the container. To obtain and to maintain a suitable vacuum, pressure, or neutral atmosphere over a period of time sufficient to give reasonable shelf life to the contents of the container, it is necessary to provide a secure and reliable sealing of the cover-to-container interface. In the past, a wide variety of cover designs and configurations have been provided for containers, with many being in the form of metal caps. However, for economic reasons and because there have been some indications that metal caps may adversely affect some foods, there has been an effort to develop an effective plastic cap for vacuum, pressure, or neutral atmosphere sealing containers, and in particular for sealing glass or plastic bottles and jars.

Over the years, many attempts have been made to develop satisfactory plastic caps for this purpose, but numerous problems have been encountered. For example, it has been found that many plastics deteriorate over a period of time, causing cracking and breaking of the cap and resulting in a poor shelf life for the packaged product. Even if the material did not crack or break, it would often gradually deform over a period of time allowing leakage around the edges of the cap and consequent spoilage of the contents. The problems of deterioration and deformation are being overcome to a large extent by the development of new plastic materials, and interest in such caps has been renewed, for it has long been known that there is a real economic advantage in plastic caps because of the ability to produce them in high quantities at reasonable cost.

Any immediate change to plastic caps has, however, been seriously impeded by the fact that theretofore there has not been a suitable structural design for a cap that would enable a manufacturer to take advantage of the apparent superiority of this material. The difficulty was that in all of the prior designs, a very exact fit between the container edge and the cap was required if the cap was to produce an effective seal, but the manufacturer was faced, in the typical manufacturing environment, with the problem of variations in the wall thickness of glass or plastic bottles and jars. With conventional molding techniques for the production of glass or plastic containers, wide variations occur in the thickness of the neck wall, even between containers made from the same mold. With prior plastic cap designs, the inside of the bottle or jar neck wall had to be precisely molded to insure that there were substantially no variations from the bottle to bottle in order to create a proper seal between the bottle and the cap intended for it. In addition, to the problem of variations in wall thickness from bottle to bottle, numerous irregularities occur along the mouth edges of such containers, either as a result of the molding process or because of chipping of the glass in handling the container, the latter problem being particularly serious when glass containers are returned for reuse. To eliminate such variations in the container to accommodate plastic caps would have required changes in glass and plastic molding techniques that would have greatly increased the costs of such containers, and would have put an end to recycling used containers.

Current linerless caps and other such caps generally exhibit a material which is a compromise between the rigidity desire or required for the outer portion to fasten with and protect the container and the resilience required for the inner portion to form an effective seal with the container.

SUMMARY OF THE INVENTION

The present invention relates to a unitary cap of two dissimilar materials adapted to engage and close the mouth of a container such as a bottle or jar and to provide a sealing closure therefor resealable. More specifically, the unitary cap comprises a substantially rigid outer closure member and a substantially resilient inner sealing member. As described the unitary cap is formed by a two-shot injection molding process which bonds the outer closure member and inner sealing member to provide the unitary cap.

In an alternate embodiment the outer closure member includes a top wall having a substantially annular side wall depending downwardly from the periphery thereof. The unitary cap may be threaded to the container or snapped or crimped on the container. An anchoring means or member comprising an annular horizontal ring extends inwardly from the inside surface of the side wall. The inner sealing member comprises a base element having a sealing element formed on the lower surface thereof.

Another alternate embodiment of the unitary cap includes an inner sealing member comprising a base element having sealing element formed on the lower surface thereof and anchoring means including anchoring members extending upwardly therefrom into rigid outer closure.

Still another alternate embodiment of the unitary cap comprises a substantially rigid outer closure member including a top wall having a diameter which is determined by the outside diameter of the container which is to enclose, and having a thickness proportional to its diameter, the thickness depending, in part, upon the degree of vacuum or pressure to be sealed and the shelf life desired of the contents.

The substantially resilient inner sealing member comprises a base element having an anchoring means extending upwardly therefrom. The anchoring means comprises one or more anchoring members. The anchoring member(s) are substantially perpendicular and/or angular to the top wall.

The sealing means comprises a pair of depending annular, inner and outer sealing flanges or sealing element and in spaced relation relative to each other on opposite sides of the base element. The inner flange is inclined inwardly toward the axis of the unitary cap, and has the smallest diameter the outer flange is spaced outwardly from flange, is inclined outwardly away from the axis, and has an intermediate diameter and the annular side wall of the outer closure member is spaced outwardly from flange and has the largest diameter. The particular spacing and angular relationship of the two flanges with respect to each other and the top wall and the side wall are not critical to the function of the unitary cap since the resiliency of the inner sealing member ensures a proper sealing operation for a variety of container wall thicknesses and imperfections. The base of the outer flange would best be spaced coincident with the base of the inner flange but not to exclude an alternate spacing. The spacing, size, and shape of the flanges must be designed to allow for penetration of the inner and outer edges and top surface of the container with the normal industry variations in container wall thicknesses and imperfections.

The outer flange extends downwardly from the base element and is angled outwardly, away from the axis of the unitary cap. The outer flange is spaced inwardly from the side wall of the unitary cap by a distance sufficient to ensure that when the unitary cap by a distance sufficient to ensure that when the unitary cap is applied to a container, the rim thereof will not force the flange outwardly into engagement with the side wall. By leaving the flange spaced sufficiently far to be free of the side wall, the flange can flex outwardly as the unitary cap is threaded onto the bottle and conform itself to the outer rim edge of the bottle thereby providing a proper seal.

The container has a mouth or top opening defined by a circumferential top rim which fits into the inner and outer flanges when the unitary cap is threaded thereon. The inner rim edge of the container engages the inner surface of flange while the outer rim edge of the container engages the inner surface of outer flange. By threading the unitary cap onto the container, the inner edge mechanically deforms flange, forcing it inwardly and upwardly toward the top wall of the unitary cap, with the mechanical force required to apply the unitary cap serving to provide a firm mechanical seal to the bottle. At the same time, the outer rim edge mechanically engages flange, deforming it slightly outwardly to again produce a firm mechanical seal.

This mechanical penetration or engagement of the sealing elements or members with the rim edges or top edges of the top rim 46 ensures a good "gasket type" seal.

The combination of the substantially rigid outer closure member and substantially resilient inner sealing member secured together by the anchoring means as a unitary component permits the use of rigid, high temperature resistance material in combination with a resilient sealing member to optimize the physical characteristics and properties of the separate members.

The invention accordingly comprises the features of construction, conbination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a cross-sectional side view, unitary cap of two dissimilar materials constructed in accordance with the present invention.

FIG. 2 is a cross-sectional side view of an alternate embodiment of the unitary cap.

FIG. 3 is a partial cross-sectional side view of another alternate embodiment of the unitary cap.

FIGS. 4 and 5 is a partial cross-sectional side view of still another alternate embodiment of the unitary cap.

Similar reference characters refer to similar parts throughout the several views of the drawings.

DETAILED DESCRIPTION OF THE PREFERRED EMBODIMENT

As shown in FIG. 1 a unitary cap 10 of two dissimilar materials made in accordance with the present invention adapted to engage and close the mouth of a container such as a bottle or jar 12 and to provide a sealing closure therefor, and after the container has been opened and the seal broke, to provide a resealable closure. The unitary cap 10 comprises a substantially rigid outer closure member 14 and a substantially resilient inner sealing member 16. Preferably, the unitary cap 10 is two-shot injection molded or otherwise formed from a suitable high temperature rigid plastic material such as a polypropylene, high density polyethylene, polycarbonate, polysulfone, or nylon for the substantially rigid outer closure member 14 and a low density polyethylene, soft vinyl or thermoplastic rubber for the substantially resilient inner sealing member 16 including a sealing means or surface 17 although the material from which the unitary cap 10 is constructed may be any plastic materials which can withstand the performance standards imposed in the use of the cap and which can provide the desired shelf life for such caps. Such materials are conventional and are known in this art. As described the unitary cap 10 is formed by a two-shot injection molding process which may bond the outer closure member 14 and inner sealing member 16 to provide the unitary cap 10.

FIG. 2 shows an alternate embodiment wherein the unitary cap 10 comprises a substantially rigid outer closure member 18 and substantially resilient inner sealing member 20. The outer closure member 18 includes a top wall 22 having a substantially annular side wall 24 depending downwardly from the periphery thereof the unitary cap 10 may be snapped or crimped to the container 12 as in FIG. 2 or threaded on the container 12 as in FIG. 1. An anchoring means or members comprising an annular horizontal ring 26 extends inwardly from the inside surface of the side wall 24. The inner sealing member 20 comprises a base element 28 having a sealing element 30 formed on the lower surface thereof. Both FIGS. 1 and 2 show a top seal.

FIG. 3 shows another alternate embodiment of the unitary cap 10 comprising a substantially rigid outer closure member partially indicated as 32 and substantially resilient inner sealing member 34 comprises a base element 36 having sealing element 38 formed on the lower surface thereof and anchoring means including anchoring members 40 extending upwardly therefrom into rigid outer closure 32.

FIG. 4 shows still another alternate embodiment of the unitary cap 10. The substantially rigid outer closure member 42 includes top wall 44 having a diameter which is determined by the outside diameter of the container 12 which is to enclose, and having a thickness proportional to its diameter, the thickness depending, in part, upon the degree of vacuum or pressure to be sealed and the shelf life desired of the cap. It has been found that a wall thickness of approximately 1/16 inch (1.588 mm) will meet the needs of most applications, although it will be apparent that the exact thickness required depends upon the size of the container 12, the degree of vacuum or pressure (if applicable) with the container 12, the particular materials used, as well as the particularly method used in manufacturing the unitary cap 10.

The substantially resilient inner sealing member 46 comprises a base element 48 having an anchoring means 50 extending upwardly therefrom and a sealing means 52 extending downwardly therefrom. The anchoring means 50 comprises perpendicular and angular anchoring members 54, 56 and 58 to the top wall 44.

The sealing means 52 comprises a pair of depending annular, inner and outer sealing flanges or sealing elements 60 and 62 respectively in spaced relation relative to each other on opposite sides of the base element 48. The inner flange 60 is inclined inwardly toward the axis of the unitary cap 10, and has the smallest diameter. The outer flange 62 is spaced outwardly from flange 60, is inclined outwardly away from the axis, and has an intermediate diameter, and the annular side wall of the outer closure member 45 is spaced outwardly from flange 62 and has the largest diameter. The particular spacing and angular relationship of the two flanges 60 and 62 with respect to each other and the top wall 44 and the side wall 45 are not critical to the function of the unitary cap 10 since the resiliency of the inner sealing member 46 ensures a proper sealing operation for a variety of container wall thicknesses and imperfections. Since the two cap sealing flanges or elements 60 and 62 function independently, a proper sealing of the container will be maintained even in the presence of a chipped inner or outer wall edge.

The inner flange 60 extends downwardly from the base element 48 and is angled inwardly toward the central axis of the unitary cap 10. The flange 60 should be sufficiently thick to ensure a good mechanical seal, yet thin enough to be resilient so that it will conform to irregularities in the container and allow penetration of the container. The exact thickness will depend on numerous factors, such as the material used, the diameter of the cap, the length of the flange 60, and the like, but in a typical application may be on the order of 1/32 inch.

The spacing, size and shape of the flanges 60 and 62 must be designed to allow for penetration of the inner and outer edges and top surface of the container 12 with normal industry variations in container wall thicknesses and imperfections.

The outer flange 62 extends downwardly from the base element 48 and is angled outwardly, away from the axis of the unitary cap 10. The outer flange 62 is spaced inwardly from the side wall 45 of the unitary cap 10 by a distance sufficient to ensure that when the unitary cap 10 is applied to a container, the rim thereof will not force the flange 62 outwardly into engagement with the side wall 45. By leaving the flange 62 spaced sufficiently far to be free of the side wall 45, the flange 62 can flex outwardly as the unitary cap 10 is threaded onto the bottle 12 and conform itself to the outer rim edge of the bottle 12 thereby providing a proper seal.

In FIG. 5, it can be seen that the container 12 has a mouth or top opening defined by a circumferential top rim 64 which fits into the space between the inner and outer flanges 60 and 62 when the unitary cap 10 is threaded thereon. The inner rim edge 74 of the container 12 engages the inner surface of flange 60 while the outer rim edge 75 of the container 12 engages the inner surface of outerflange 62. By threading the unitary cap 10 onto the container 12, the inner edge mechanically deforms flange 60, forcing it inwardly and upwardly toward the top wall 44 of the unitary cap 10, with the mechanical force required to apply the unitary cap 10, with the mechanical force required to apply the unitary cap 10 serving to provide a firm mechanical seal to the bottle 12. At the same time, the outer rim edge mechanically engages flange 62, deforming it slightly outwardly to again produce a firm mechanical seal.

This mechanical penetration or engagement of the sealing elements or members with the rim edges or top edge of the top rim 64 ensures a good "gasket type" seal.

The combination of the substantially rigid outer closure member 14 and substantially resilient inner sealing member 16 secured together by the anchoring means as a unitary component permits the use of rigid, high temperature resistance material in combination with a resilient sealing member to optimize the physical characteristics and properties of the separate members 14 and 16 or as designated in the alternate embodiment.

Thus there has been disclosed a new and improved cap for bottles, jars, and other contains 12 which overcomes the disadvantages of prior art devices, and which provides a reliable and more economical seal for such containers 12. This unique combination provides effect top or edge sealing in vacuum, pressure and neutral applications. The unitary cap 10 may be easily manufactured, as by two-shot injection molding techniques, and ensures a reliable seal for bottles 12 of various thicknesses and having anomalies such as variations in the wall thickness and cracks and chips along the rim edges thereof. Although the invention has been disclosed in terms of a specific embodiment, it will be appreciated that numerous modifications and variations may be made by those of skill in the art without departing from the true spirit and scope thereof as set forth in the following claims.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A unitary cap of two dissimilar materials for containers, comprising a substantially rigid outer closure member and a substantially resilient inner sealing member secured thereto, said substantially rigid outer closure member including a top wall to extend over and cover a container mouth; and an annular side wall depending from the perimeter of said top wall and integrally formed therewith; said substantially resilient inner sealing member including a sealing means formed thereon to sealingly engage the container, said substantially resilient inner sealing member comprising a base element having an anchor means extending upwardly therefrom to secure said substantially resilient inner sealing member to said substantially rigid outer closure member, said anchoring means comprises an anchoring member disposed substantially perpendicular to said base element and a pair of anchoring members disposed angularly relative to said base element on opposite sides of said substantially perpendicular anchoring member.

2. The unitary cap of claim 1 wherein said sealing means comprise an outer sealing flange.

3. The unitary cap of claim 2 wherein said sealing means comprise an inner sealing flange.

4. The unitary cap of claim 3 wherein said outer flange is spaced from said side wall a distance sufficient to prevent contact therebetween when said cap has been applied to a container.

5. The unitary cap of claim 4 wherein said inner and outer flanges are so spaced and so angled with respect to said top wall that said flanges will engage only the rim edges and top surface of the wall of a container to which said cap is applied.

* * * * *